US007657162B2

(12) United States Patent
Itoigawa et al.

(10) Patent No.: US 7,657,162 B2
(45) Date of Patent: Feb. 2, 2010

(54) HAND DRYER APPARATUS

(75) Inventors: Yasuyuki Itoigawa, Tokyo (JP); Keiji Kameishi, Tokyo (JP)

(73) Assignee: Mitsubishi Electric Corporation, Chiyoda-Ku, Tokyo (JP)

( * ) Notice: Subject to any disclaimer, the term of this patent is extended or adjusted under 35 U.S.C. 154(b) by 264 days.

(21) Appl. No.: 11/797,342

(22) Filed: May 2, 2007

(65) Prior Publication Data

US 2009/0154907 A9 Jun. 18, 2009

Related U.S. Application Data

(63) Continuation of application No. PCT/JP2006/312907, filed on Jun. 28, 2006.

(51) Int. Cl.
*A45D 20/10* (2006.01)

(52) U.S. Cl. ..... 392/384; 392/380; 392/381

(58) Field of Classification Search ..... None
See application file for complete search history.

(56) References Cited

U.S. PATENT DOCUMENTS

| | | | | |
|---|---|---|---|---|
| 5,459,944 | A | 10/1995 | Tatsutani et al. | |
| 6,189,230 | B1 * | 2/2001 | Huen | 34/90 |
| D548,399 | S * | 8/2007 | Nikaido et al. | D28/54.1 |
| 7,437,833 | B2 * | 10/2008 | Sato et al. | 34/90 |
| 2007/0079524 | A1 * | 4/2007 | Sato et al. | 34/202 |
| 2007/0263994 | A1 * | 11/2007 | Diez et al. | 392/380 |
| 2008/0317448 | A1 * | 12/2008 | Brown et al. | 392/380 |
| 2009/0000142 | A1 * | 1/2009 | Churchill et al. | 34/95 |
| 2009/0034946 | A1 * | 2/2009 | Caine et al. | 392/380 |

FOREIGN PATENT DOCUMENTS

| | | | |
|---|---|---|---|
| JP | 06-062977 | A | 3/1994 |
| JP | 7-116076 | A | 5/1995 |
| JP | 7-136078 | A | 5/1995 |
| JP | 7-327864 | A | 12/1995 |
| JP | 08-318176 | A | 12/1996 |
| JP | 11-283 | A | 1/1999 |
| JP | 2000-107073 | A | 4/2000 |
| JP | 2002-136448 | A | 5/2002 |
| JP | 2005-160873 | A | 6/2005 |

* cited by examiner

*Primary Examiner*—Thor S Campbell
(74) *Attorney, Agent, or Firm*—Buchanan Ingersoll & Rooney PC

(57) ABSTRACT

A hand inserting portion is opened at one surface of a casing or at both the one surface and other surface of the casing. The hand inserting portion includes a space in which hands can be accommodated. A high-pressure-airstream generating unit generates a high-speed airstream. A nozzle is provided on each of two opposing sides of the hand inserting portion, from which the high-speed airstream is jetted into the space of the hand inserting portion. The nozzle includes a hole array formed by arranging a plurality of nozzle holes in a row. Air volume of the high-speed airstream is larger at a central portion of the hole array than at other portions of the hole array.

13 Claims, 5 Drawing Sheets

HAND DRYER APPARATUS

CROSS REFERENCE TO RELATED APPLICATION

This application is a Continuation Application of International Application No. PCT/JP2006/312907, filed Jun. 28, 2006.

TECHNICAL FIELD

The present invention relates to a hand dryer that sanitarily dries wet hands after being washed by a blast of high-speed airstream.

BACKGROUND ART

A hand dryer that dries wet hands has a following configuration. That is, a hand inserting portion which is opened at a front face and side faces and has a space in which hands can be accommodated is provided in a casing constituting an outer shell of the hand dryer, and a high-pressure-airstream generating unit that generates high-speed airstream is incorporated inside the casing. Nozzles are respectively provided on opposing two faces of an inner wall of the hand inserting portion. The high-pressure-airstream generating unit changes air sucked from an air suction port provided on an outer surface of the casing into high-speed airstream to blast the airstream into the hand inserting portion from the nozzles.

In a hand dryer with such a configuration, when a user inserts the hands into the hand inserting portion, a sensor provided in the hand inserting portion detects the hands and the high-pressure-airstream generating unit is activated to jet high-pressure air into the hand inserting portion from the opposing nozzles, so that water droplets on wet hands are blown off to dry the hands (see, for example, Patent Document 1).

Patent Document 1: Japanese Patent Application Laid-Open No. H7-116076

DISCLOSURE OF INVENTION

Problem to be Solved by the Invention

However, in a conventional hand dryer having the above configuration, there is a problem that water droplets around thumbs of washed wet hands cannot be blown off sufficiently. The reason of this phenomenon is as follows. That is, when a user naturally inserts the hands into the hand inserting portion, the thumbs are positioned near a central portion in a horizontal direction of the hand inserting portion. Regarding a position in front and back directions, the thumbs are positioned lopsidedly away from a back side face of the hand inserting portion, and near a front side face thereof. Therefore, a distance from a nozzle provided on the back side face increases, and air is attenuated and cannot reach close enough to the thumbs sufficiently, so that water droplets cannot be blown off efficiently.

The present invention has been achieved to solve the above problem, and an object of the present invention is to provide a hand dryer whose drying ability is improved so that, for example, even water droplets on thumbs positioned lopsidedly near a central portion of the hand inserting portion can be blown off efficiently and sufficiently.

Means for Solving Problem

To solve the above problems, a hand dryer according to the present invention jets high-speed airstream into a hand inserting portion, which is opened at a front face of a casing or opened at the front face and side faces and has a space in which hands can be accommodated, from nozzles respectively provided on opposing faces of the hand inserting portion by a high-pressure-airstream generating unit which is provided in the casing and generates high-speed airstream. The nozzle includes a hole row formed by arranging a plurality of nozzle holes in a row in a horizontal direction of the hand inserting portion so that air volume of high-speed airstream jetted from a central portion of the hole row is made larger than air volume jetted from the other portions.

Effect of the Invention

According to the hand dryer of the present invention, because an air volume of high-speed airstream from a central portion of a hole row of the nozzle is made larger than air volume from the other portions, drying ability is improved so that, for example, even water droplets on thumbs positioned lopsidedly near a central portion of the hand inserting portion can be blown off efficiently and sufficiently.

EXPLANATIONS OF LETTERS OR NUMERALS

Figure 1:
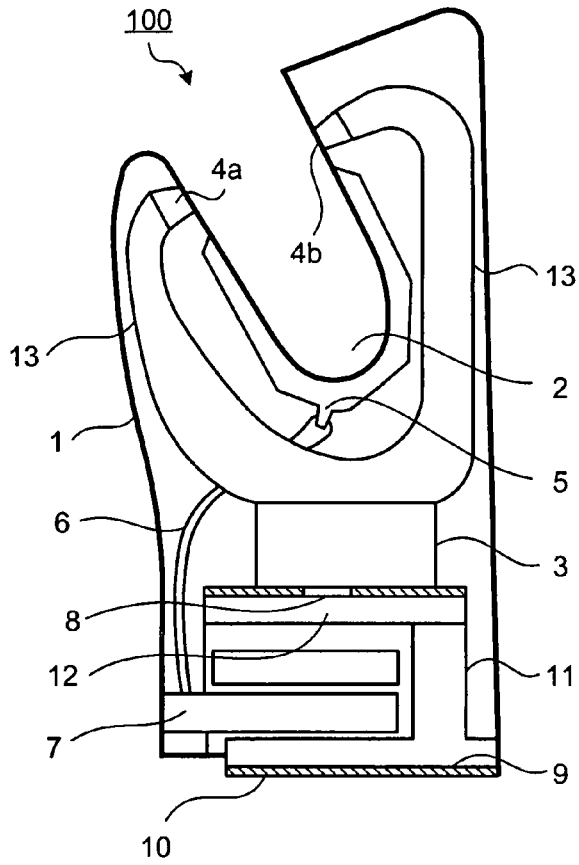
FIG. 1 is a vertical cross section of a hand dryer according to a first embodiment of the present invention.

1 Casing
2 Hand inserting portion
3 High-pressure-airstream generating unit
4*a* Front nozzle
4*b* Back nozzle
5 Drain port
6 Drain pipe
7 Drain tank
8 Suction port of high-pressure-airstream generating unit
9 Air suction port
10 Filter
11 Air suction duct
12 Chamber

13 Air discharge duct
14, 15, 17, 19, 21 Hole group
16, 18, 22 Slit-like nozzle hole

BEST MODE(S) FOR CARRYING OUT THE INVENTION

Exemplary embodiments of a hand dryer according to the present invention will be explained in detail with reference to the accompanying drawings. The invention is not limited to the embodiments.

First Embodiment

FIG. 1 is a vertical cross section of a hand dryer according to a first embodiment of the present invention. In FIG. 1, a hand dryer 100 has a casing 1 constituting an outer shell and a high-pressure-airstream generating unit 3 accommodated inside the casing 1. A hand inserting portion 2 having a U-shaped cross section in which a front face and side faces are opened is provided in the casing 1. The hand inserting portion 2 has a space in which a user can accommodate the hands. A front nozzle 4*a* and a back nozzle 4*b* that jet high-speed airstream are provided on opposing faces of the hand inserting portion 2.

A drain port 5 is provided at a bottom of the hand inserting portion 2. A drain pipe 6 for leading collected water in the hand inserting portion 2 to a drain tank 7 provided at a lower portion of the casing 1 is connected to the drain port 5. An air suction duct 11 that supplies air sucked from an air suction port 9 to the high-pressure-airstream generating unit 3 is provided between a suction port 8 of the high-pressure-airstream generating unit 3 and the air suction port 9 provided at a lower side of the casing 1. A chamber 12 is formed at an upstream of the air suction duct 11 (side of the high-pressure-airstream generating unit 3). The air suction port 9 is covered with a filter 10. An air discharge duct 13 for leading high-pressure airstream generated by the high-pressure-airstream generating unit 3 to the front nozzle 4*a* and the back nozzle 4*b* is provided between the high-pressure-airstream generating unit 3 and the hand inserting portion 2.

In the hand dryer 100 thus configured, when hands are inserted into the hand inserting portion 2, a sensor (not shown) provided in the hand inserting portion 2 detects the hands and the high-pressure-airstream generating unit 3 is activated. When the high-pressure-airstream generating unit 3 is activated, air sucked from the air suction port 9 enters into the high-pressure-airstream generating unit 3 from the suction port 8 via the air suction duct 11 to be pressurized.

Air pressurized by the high-pressure-airstream generating unit 3 passes through the air discharge duct 13 to be jetted as high-speed airstream into the hand inserting portion 2 from the front nozzle 4*a* and the back nozzle 4*b*. The high-speed airstream blows onto wet hands to blow off water droplets thereon so as to dry the hands. The blown-off water droplets drip down an inner wall of the hand inserting portion 2 and pass through the drain pipe 6 via the drain port 5 to be collected in the drain tank 7.

As described above, in the hand dryer, the problem to be solved is to efficiently blow off water droplets on the thumbs with a relatively large amount of water droplets left thereon. In the embodiment, to solve the problem, air volume of high-speed airstream jetted from a central portion of the hand inserting portion 2 corresponding to a position of the thumbs at the time of hand insertion is made larger than that of a conventional hand dryer. More specifically, an occupation ratio of nozzle holes per unit area of the inner wall of the hand inserting portion 2 is increased at the central portion of the hand inserting portion 2 and it is decreased at other portions so that the air volume of the high-speed airstream jetted from the central portion of the hand inserting portion 2 is made larger than air volume jetted from the other portions.

While the high-pressure-airstream generating unit 3 of the embodiment is similar to a conventional high-pressure-airstream generating unit, it can be changed with a high-pressure-airstream generating unit having high air blasting ability along with an increase of air volume at the central portion of the hand inserting portion 2. Accordingly, the air volume at the central portion can be reliably increased without reducing the air volume at portions other than the central portion of the hand inserting portion 2.

Figure 2:
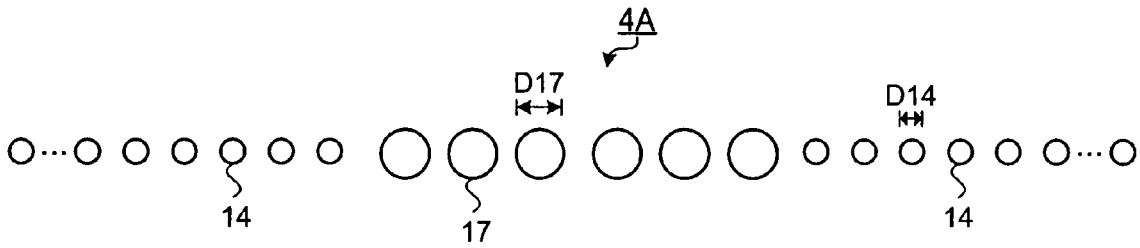
FIG. 2 is a schematic diagram of a shape of a blast nozzle according to the first embodiment.

FIG. 2 depicts shapes of the front nozzle 4*a* and the back nozzle 4*b* of the embodiment. The front nozzle 4*a* and the back nozzle 4*b* provided to be opposite to each other have the same hole shape. In FIG. 2, the front nozzle 4*a* and the back nozzle 4*b* are shown as a nozzle 4A. The nozzle 4A includes a hole row formed by arranging a plurality of nozzle holes in a row in a horizontal direction of the hand inserting portion 2. More particularly, the hole row is formed by arranging hole groups 14 and 17 in which nozzle holes are aligned in a column. The whole length (a horizontal width) of the hole row (nozzle) is about a length of both hands opened and laid side by side (about 250 millimeters) (it is assumed that both thumbs of opened hands are laid side by side). A length (a horizontal width) of the hole group 17 provided at the central portion is about a length of a horizontal width of both thumbs laid side by side. In the embodiment, a diameter D17 of a nozzle hole of the hole group 17 provided at the central portion is made larger than a diameter D14 of a nozzle hole of the hole group 14 provided at the other portions (portions other than the central portion). With this configuration, air volume of high-speed airstream jetted from the central portion of the horizontal hole row becomes larger than air volume jetted from the other portions. In the embodiment, a diameter of the nozzle hole is made large to reduce attenuation of a central wind speed.

In the hand dryer thus configured, since air volume of high-speed airstream jetted from the central portion of the hole row can be increased, and attenuation of wind speed of the high-speed airstream at the central portion can be decreased, volume of the high-speed airstream blowing onto the hands can be increased and a speed thereof can be increased. Accordingly, water droplets on the thumbs with a relatively large amount of water droplets left thereon can be blown off efficiently, so that a hand dryer with efficient drying performance can be provided.

Second Embodiment

Figure 3:
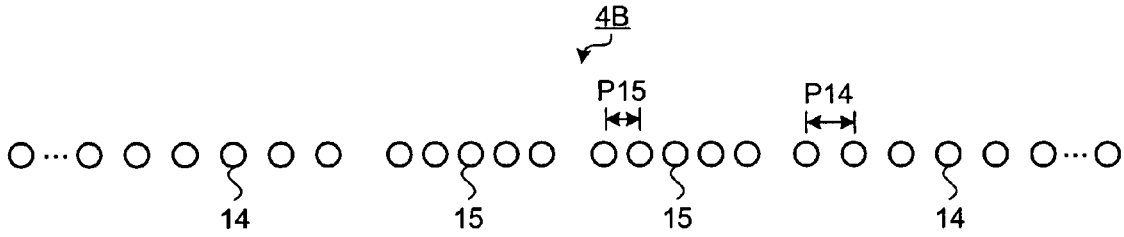
FIG. 3 is a schematic diagram of a shape of a blast nozzle according to a second embodiment of the present invention.

FIG. 3 depicts shapes of a front nozzle and a back nozzle of a hand dryer according to a second embodiment of the present invention. In a nozzle 4B of the embodiment, a hole row is formed by arranging hole groups 14 and 15 in which a plurality of nozzle holes are aligned in a plurality of groups. The whole length of the hole row (nozzle) is about a length of both hands opened and laid side by side. A length of the hole group 15 provided at the central portion is about a length of a horizontal width of both thumbs laid side by side. In the embodiment, a pitch P15 of nozzle holes of the hole groups 15 provided at the central portion is made smaller than a pitch P14 of nozzle holes of the hole groups 14 provided at the other portions, thus, air volume of high-speed airstream jetted from the central portion of the hole row is made larger than air volume jetted from the other portions. The other configuration is the same as the first embodiment.

Figure 12:
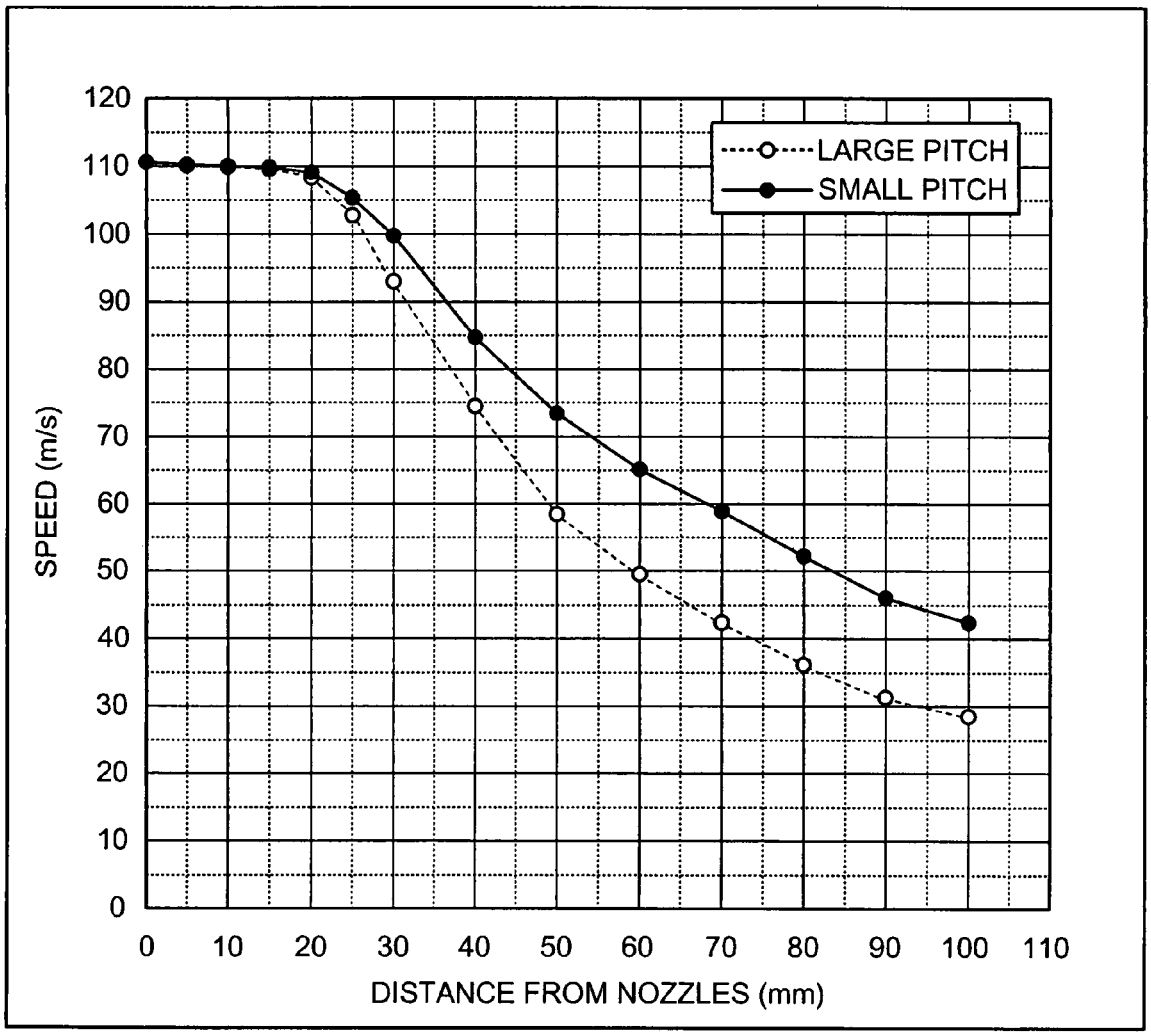
FIG. 12 is a graph of a relationship between a distance and a speed when a high-speed airstream is jetted from a nozzle according to the present embodiment in comparison with a case when a high-speed airstream is jetted from a single nozzle hole.

FIG. 12 is a graph showing a relationship between a distance and a speed when high-speed airstream is jetted from a nozzle in comparison with a relationship therebetween when high-speed airstream is jetted from a single nozzle hole. A horizontal axis shows a distance [mm] from the nozzle 4B, and a vertical axis shows a speed [m/s] of high-speed airstream at the distance. A black circle in FIG. 12 represents a relationship between a distance and a speed at the central portion of the nozzle 4B of the embodiment in which a pitch is made small. On the other hand, a white circle in FIG. 12 represents a relationship between a distance and a speed when a single nozzle hole having the same hole diameter is used (assuming that a pitch is sufficiently large). With reference to FIG. 12, it is understood that a speed of high-speed airstream becomes slow (speed is attenuated) according to increase of a distance from the nozzle 4B. However, when the nozzle holes are close to each other at a predetermined pitch or less like the nozzle 4B of the embodiment, involved ambient air volume is reduced because of merging of high-speed airstreams jetted from mutual nozzle holes to suppress speed attenuation. That is, the speed of high-speed airstream at the central portion becomes faster than it is conventionally. It is understood from various tests that an effect of suppression of speed attenuation increases along with reduction of the pitch. Accordingly, by the effect of suppressing the speed attenuation, water droplets on the thumbs with a relatively large amount of water droplets left thereon can be blown off easily.

Third Embodiment

Figure 4:
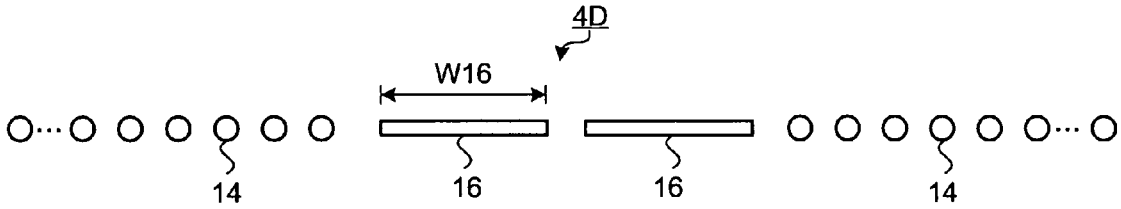
FIG. 4 is a schematic diagram of a shape of a blast nozzle according to a third embodiment of the present invention.

FIG. 4 depicts shapes of a front nozzle and a back nozzle of a hand dryer according to a third embodiment of the present invention. In a nozzle 4D of the embodiment, a hole row is formed by arranging a plurality of the hole groups 14 including a plurality of nozzle holes and slit-like nozzle holes 16 which are long in a horizontal direction of the hand inserting portion. The whole length of the hole row (nozzle) is about a length of both hands opened and laid side by side. The length of the slit-like nozzle hole 16 provided at the central portion is about a length of a horizontal width of both thumbs laid side by side. A horizontal length W16 of the slit-like nozzle hole 16 formed at the central portion of the hole row corresponds to a length of a plurality of pitches of circular nozzle holes 14 formed at the other portions of the hole row, thereby increasing air volume of high-speed airstream jetted from the central portion of the hole row.

In the hand dryer thus configured, since air volume of high-speed airstream jetted from the central portion of the hole row can be increased, and the slit-like nozzle holes can reduce attenuation of a wind speed by a uniform jet flow, volume of high-speed airstream blowing onto the hands can be increased and a speed thereof can be increased, so that a hand dryer with high drying performance can be provided. Water droplets on the thumbs of the hands with a relatively large amount of water droplets left thereon can be blown off by the effect.

Fourth Embodiment

Figure 5:
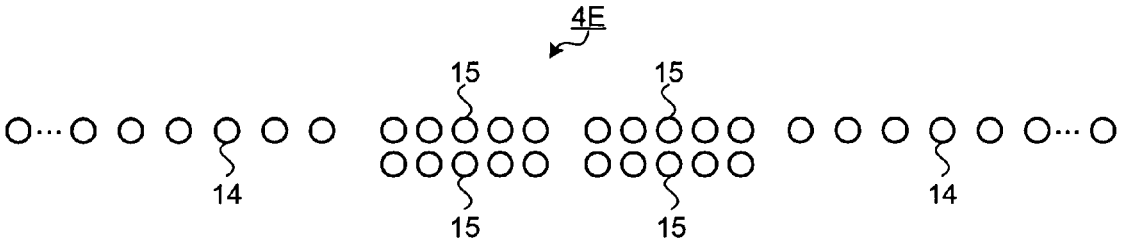
FIG. 5 is a schematic diagram of a shape of a blast nozzle according to a fourth embodiment of the present invention.

FIG. 5 depicts shapes of a front nozzle and a back nozzle of a hand dryer according to a fourth embodiment of the present invention. In a nozzle 4E of the embodiment, hole groups 15 in which a plurality of nozzle holes are aligned at a reduced pitch are formed in two stages in a vertical direction at the central portion. The hole groups 14 in which a plurality of nozzle holes are aligned at a large pitch are formed at the other portions. The whole length of the hole row (nozzle) is about a length of both hands opened and laid side by side. A length of the hole group 15 provided at the central portion is about a length of a horizontal width of both thumbs laid side by side. With this configuration, air volume of high-speed airstream jetted from the central portion of the hole row becomes large.

In the hand dryer thus configured, since air volume of high-speed airstream jetted from the central portion of the hand inserting portion can be further increased, and attenuation of a wind speed can be reduced by exerting a greater effect of merging, volume of the high-speed airstream blowing onto the hands can be increased and a speed thereof can be increased, so that a hand dryer with efficient drying performance can be provided.

Fifth Embodiment

Figure 6:
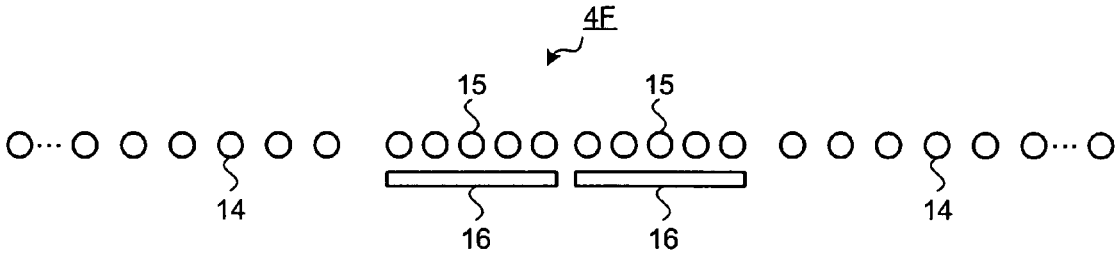
FIG. 6 is a schematic diagram of a shape of a blast nozzle according to a fifth embodiment of the present invention.

FIG. 6 depicts shapes of a front nozzle and a back nozzle of a hand dryer according to a fifth embodiment of the present invention. In a nozzle 4F of the embodiment, the hole group 15 in which a plurality of nozzle holes are aligned at a reduced pitch and the slit-like nozzle hole 16 having the same length as the hole group 15 are formed in two stages in a vertical direction at the central portion. The hole group 14 in which a plurality of nozzle holes are aligned at a large pitch is formed at the other portions. The whole length of the hole row (nozzle) is about a length of both hands opened and laid side by side. A length of the hole group 15 and the slit-like nozzle hole 16 provided at the central portion is about a length of a horizontal width of both thumbs laid side by side. Thus, the air volume of high-speed airstream jetted from the central portion of the hole row is increased.

In the hand dryer thus configured, since air volume of high-speed airstream jetted from the central portion of the hand inserting portion can be increased, and the slit-like nozzle holes can further reduce attenuation of a wind speed by a uniform jet flow, volume of the high-speed airstream blowing onto the hands can be increased and a speed thereof can be increased, so that a hand dryer with drying performance can be provided.

Sixth Embodiment

Figure 7:
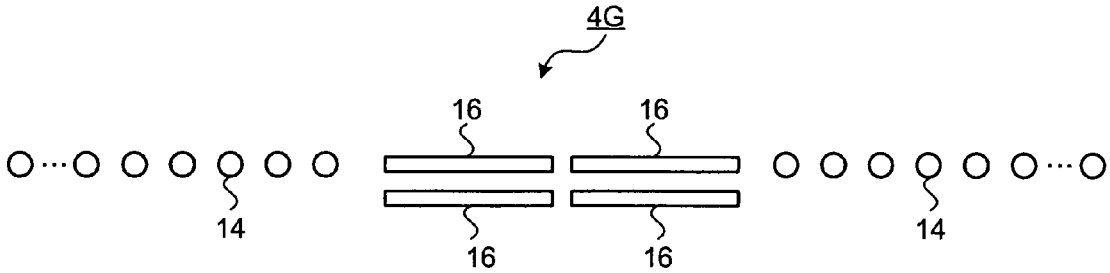
FIG. 7 is a schematic diagram of a shape of a blast nozzle according to a sixth embodiment of the present invention.

FIG. 7 depicts shapes of a front nozzle and a back nozzle of a hand dryer according to a sixth embodiment of the present invention. In a nozzle 4G of the embodiment, the slit-like nozzle holes 16 are formed in two stages in a vertical direction at the central portion. The hole groups 14 in which six nozzle holes are aligned at a large pitch are formed at the other portions. The whole length of the hole row (nozzle) is about a length of both hands opened and laid side by side. A length of the slit-like nozzle hole 16 provided at the central portion is about a length of a horizontal width of both thumbs laid side by side. In this manner, air volume of high-speed airstream jetted from the central portion of the hole row is increased.

In the hand dryer thus configured, since air volume of a high-speed airstream jetted from the central portion of the hand inserting portion can be further increased, and the slit-like nozzles hole can further reduce attenuation of a wind speed by a uniform jet flow, volume of the high-speed airstream blowing onto the hands can be increased and a speed thereof can be increased, so that a hand dryer with drying performance can be provided.

Seventh Embodiment

Figure 8:
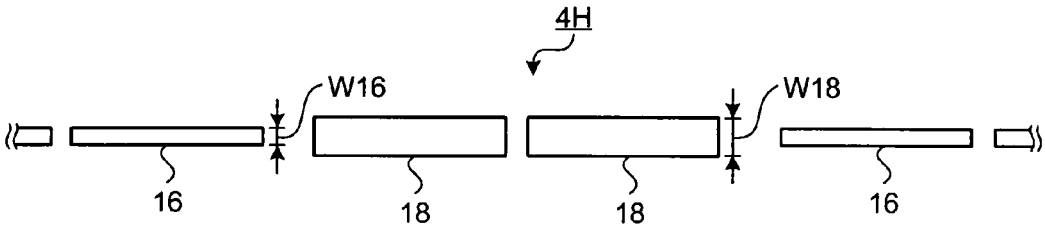
FIG. 8 is a schematic diagram of a shape of a blast nozzle according to a seventh embodiment of the present invention.

FIG. 8 depicts shapes of a front nozzle and a back nozzle of a hand dryer according to a seventh embodiment of the present invention. In a nozzle 4H of the embodiment, a vertical width W18 of slit-like nozzle holes 18 provided at the central portion is made larger than a vertical width W16 of the slit-like nozzle holes 16 provided at the other portions. The whole length of the hole row (nozzle) is about a length of both hands opened and laid side by side. Lengths of the slit-like nozzle holes 18 provided at the central portion is about a length of a horizontal width of both thumbs laid side by side. Accordingly, air volume of a high-speed airstream jetted from the central portion of the hole row is increased.

In the hand dryer thus configured, since air volume of high-speed airstream jetted from the central portion of the hand inserting portion can be further increased, and the slit-like nozzle holes can further reduce attenuation of a wind speed by a uniform jet flow, volume of the high-speed airstream blowing onto the hands can be increased and a speed thereof can be increased, so that a hand dryer with drying performance can be provided.

Eighth Embodiment

Figure 9:
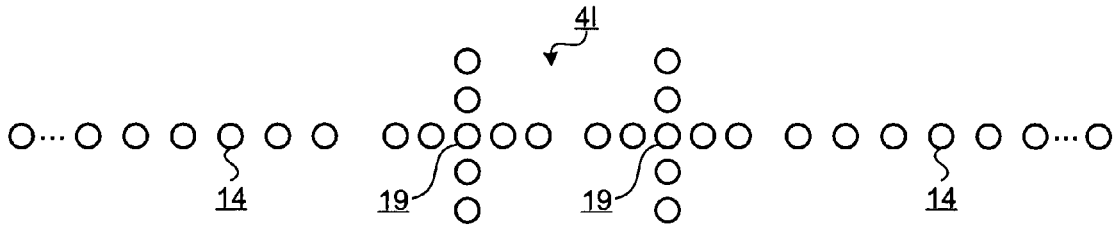
FIG. 9 is a schematic diagram of a shape of a blast nozzle according to an eighth embodiment of the present invention.

FIG. 9 depicts shapes of a front nozzle and a back nozzle of a hand dryer according to an eighth embodiment of the present invention. In a nozzle 4I of the embodiment, a hole row is formed by arranging a plurality of hole groups including a plurality of nozzle holes in a horizontal direction of the hand inserting portion, and hole groups 19 provided at the central portion are formed by arranging nozzle holes in a horizontal direction and a vertical direction to form a cross shape, while the hole groups 14 provided at the other portions are formed by arranging nozzle holes only in a horizontal direction, so that air volume of high-speed airstream jetted from the central portion of the hole row is increased. A pitch of the nozzle holes of the hole group 19 provided at the central portion is made smaller than that of the hole group 14 so that air volume of high-speed airstream jetted from the central portion of the hole row is increased. The whole length of the hole row (nozzle) is about a length of both hands opened and laid side by side. A horizontal length of the hole group 19 provided at the central portion is about a length of a horizontal width of both thumbs laid side by side.

In the hand dryer thus configured, since air volume of high-speed airstream jetted from the central portion of the hand inserting portion can be further increased, and attenuation of a wind speed can be reduced by exerting an effect of merging even in a vertical direction, volume of the high-speed airstream blowing onto the hands can be increased and speed thereof can be increased, so that a hand dryer with efficient drying performance can be provided.

While the hole group 19 of the embodiment is formed by arranging the nozzle holes in a horizontal direction and a vertical direction to form a cross shape, it is only necessary that the nozzle holes are arranged in approximately horizontal and vertical directions, so that, even if the nozzle holes cross diagonally or are arranged to form a T-shape, for example, a predetermined effect can be obtained.

Ninth Embodiment

Figure 10:
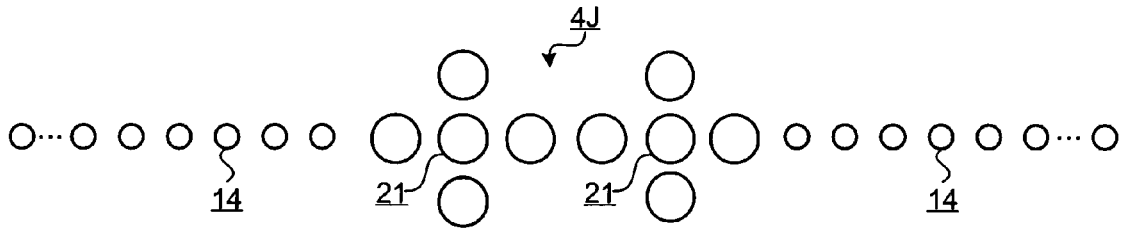
FIG. 10 is a schematic diagram of a shape of a blast nozzle according to a ninth embodiment of the present invention.

FIG. 10 depicts shapes of a front nozzle and a back nozzle of a hand dryer according to a ninth embodiment of the present invention. In a nozzle 4J of the embodiment, hole groups 21 provided at the central portion are formed by arranging nozzle holes in a horizontal direction and a vertical direction, while the hole groups 14 provided at the other portions are formed by arranging nozzle holes only in a horizontal direction, so that air volume of high-speed airstream jetted from the central portion of the hole row is increased. A hole diameter of a nozzle hole of the hole group 21 provided at the central portion is made larger than that of the hole group 14, so that air volume of the high-speed airstream jetted from the central portion of the hole row is further increased. The whole length of the hole row (nozzle) is about a length of both hands opened and laid side by side. A horizontal length of the hole group 21 provided at the central portion is about a length of a horizontal width of both thumbs laid side by side.

In the hand dryer thus configured, since air volume of the high-speed airstream jetted from the central portion of the hand inserting portion can be further increased, and attenuation of a central wind speed can be reduced by increasing a diameter of the nozzle hole, volume of the high-speed airstream blowing onto the hands can be increased and a speed thereof can be increased, so that a hand dryer with efficient drying performance can be provided.

Tenth Embodiment

Figure 11:
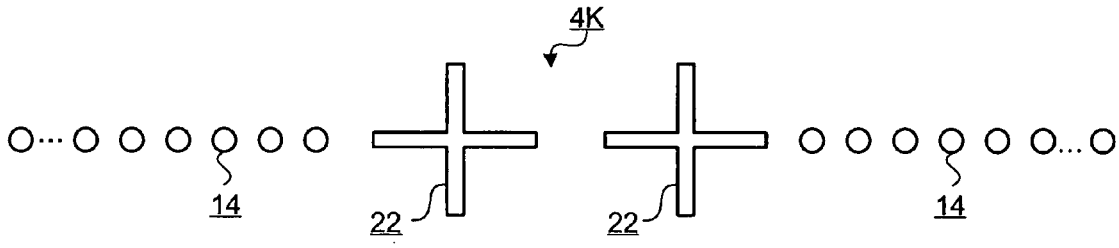
FIG. 11 is a schematic diagram of a shape of a blast nozzle according to a tenth embodiment of the present invention.

FIG. 11 depicts shapes of a front nozzle and a back nozzle of a hand dryer according to a tenth embodiment of the present invention. In a nozzle 4K of the embodiment, nozzle holes 22 provided at the central portion are formed in a slit-like cross shape which is long in a horizontal direction and a vertical direction, while the hole groups 14 provided at the other portions are formed by arranging nozzle holes only in a horizontal direction, so that air volume of high-speed airstream jetted from the central portion of the hole row is increased. The whole length of the hole row (nozzle) is about a length of both hands opened and laid side by side. A horizontal length of the nozzle hole 22 provided at the central portion is about a length of a horizontal width of both thumbs laid side by side.

In the hand dryer thus configured, since air volume of the high-speed airstream jetted from the central portion of the hand inserting portion can be further increased, and the slit-like nozzle holes can further reduce attenuation of a wind speed by a uniform jet flow, volume of the high-speed airstream blowing onto the hands can be increased and a speed thereof can be increased, so that a hand dryer with efficient drying performance can be provided.

While the slit-like nozzle hole 22 of the embodiment is formed in a cross shape, it is only necessary that slits extend in approximately horizontal and vertical directions, so that, even if the slit-like nozzle hole is formed in a diagonally intersecting shape or is formed in a T-shape, for example, a predetermined effect can be obtained.

While the hand inserting portion 2 according to the first to the tenth embodiments is formed in the casing 1 of the hand dryer so as to be opened at the front face and the side faces, a hand inserting portion can be formed to have an opening only at the front face.

The invention claimed is:

1. A hand dryer apparatus comprising:

a casing that forms a frame of the hand dryer apparatus, the casing including one surface and an other surface;

a hand inserting portion that is opened at the one surface or at both the one surface and the other surface, the hand inserting portion including a space in which hands can be accommodated;

a high-pressure-airstream generating unit that generates a high-speed airstream; and a nozzle provided on each of two opposing sides of the hand inserting portion, from which the high-speed airstream is jetted into the space of the hand inserting portion, wherein the nozzle includes a hole array formed by arranging a plurality of nozzle holes in a row, and an air volume of the high-speed airstream is larger at a central portion of the hand insertion portion than at other portions of the hand insertion portion.

2. The hand dryer apparatus according to claim 1, wherein occupation ratios of the nozzle holes per unit area are larger at the central portion of the hand insertion portion than at the other portions of the hand insertion portion.

3. The hand dryer apparatus according to claim 1, wherein diameters of the nozzle holes are larger at the central portion of the hand insertion portion than at the other portions of the hand insertion portion.

4. The hand dryer apparatus according to claim 1, wherein pitches of the nozzle holes are smaller at the central portion of the hand insertion portion than at the other portions of the hand insertion portion.

5. The hand dryer apparatus according to claim 1, wherein the nozzle holes at the central portion of the hand insertion portion have a shape of a slit, the nozzle holes at the other portions of the hand insertion portion have a shape of a circle, and a length of the slit is longer than a diameter of the circle.

6. The hand dryer apparatus according to claim 1, wherein a number of rows of the nozzle holes in a direction perpendicular to a direction of the hole array is larger at the central portion of the hand insertion portion than at the other portions of the hand insertion portion.

7. The hand dryer apparatus according to claim 6, wherein the rows of the nozzle holes at the central portion include a row of slit nozzle holes and a row of circular nozzle holes.

8. The hand dryer apparatus according to claim 6, wherein the rows of the nozzle holes at the central portion include a plurality of rows of slit nozzle holes.

9. The hand dryer apparatus according to claim 1, wherein the nozzle holes have a shape of a slit, and a width of the slit of the nozzles holes at the central portion of the hand insertion portion in a direction perpendicular to a direction of the hole array is wider than a width of the slit of the nozzles holes at the other portions of the hand insertion portion in said direction.

10. The hand dryer apparatus according to claim 1, wherein the hole array is formed by arranging a plurality of hole groups including a plurality of nozzle holes, and the hole groups at the central portion of the hand insertion portion are formed by arranging the nozzle holes in both one direction and an other direction perpendicular to the one direction while the hole groups at the other portions of the hand insertion portion are formed by arranging the nozzle holes in the one direction.

11. The hand dryer apparatus according to claim 10, wherein pitches of the hole groups are smaller at the central portion of the hand insertion portion than at the other portions of the hand insertion portion.

12. The hand dryer apparatus according to claim 10, wherein diameters of the nozzle holes of the hole groups are larger at the central portion of the hand insertion portion than at the other portions of the hand insertion portion.

13. The hand dryer apparatus according to claim 1, wherein the hole array is formed by arranging a plurality of hole groups including a plurality of nozzle holes, the nozzle holes of the hole groups at the central portion of the hand insertion portion have a shape of a crossed slit, the nozzle holes of the hole groups at the other portions of the hand insertion portion have a shape of a circle, and a length of the crossed slit both in a direction of the hole array and in a direction perpendicular to the direction of the hole array is longer than a diameter of the circle.

* * * * *